US007064650B2

(12) United States Patent
Bieck et al.

(10) Patent No.: US 7,064,650 B2
(45) Date of Patent: Jun. 20, 2006

(54) FOIL-TYPE SWITCHING ELEMENT

(75) Inventors: Werner Bieck, Wiltingen (DE); Yves Decoster, Ethe Virton (BE); Alain Schumacher, Konz (DE); Thomas Schleeh, Trier (DE)

(73) Assignee: IEE International Electronics & Engineering S.A., Echternach (LU)

( * ) Notice: Subject to any disclaimer, the term of this patent is extended or adjusted under 35 U.S.C. 154(b) by 0 days.

(21) Appl. No.: 10/478,214

(22) PCT Filed: May 24, 2002

(86) PCT No.: PCT/EP02/05717

§ 371 (c)(1),
(2), (4) Date: Aug. 2, 2004

(87) PCT Pub. No.: WO02/097838

PCT Pub. Date: Dec. 5, 2002

(65) Prior Publication Data

US 2004/0246094 A1 Dec. 9, 2004

(30) Foreign Application Priority Data

May 28, 2001 (LU) ..... 90783

(51) Int. Cl.
*H01C 10/10* (2006.01)

(52) U.S. Cl. ..... 338/47; 338/114

(58) Field of Classification Search ..... 338/47, 338/99, 114
See application file for complete search history.

(56) References Cited

U.S. PATENT DOCUMENTS

| | | | | |
|---|---|---|---|---|
| 4,314,227 | A * | 2/1982 | Eventoff | 338/99 |
| 4,489,302 | A | 12/1984 | Eventoff | |
| 4,495,236 | A | 1/1985 | Obara et al. | |
| 4,996,511 | A * | 2/1991 | Ohkawa et al. | 338/114 |
| 5,948,990 | A * | 9/1999 | Hashida | 73/725 |
| 6,531,951 | B1 * | 3/2003 | Serban et al. | 338/47 |

FOREIGN PATENT DOCUMENTS

| | | |
|---|---|---|
| DE | 36 43 124 | 7/1988 |
| JP | 2-27627 | 1/1990 |
| JP | 2-37629 | 2/1990 |
| WO | 99/38179 | 7/1999 |

* cited by examiner

*Primary Examiner*—Tu Hoang
(74) *Attorney, Agent, or Firm*—Oblon, Spivak, McClelland, Maier & Neustadt, P.C.

(57) ABSTRACT

A foil-type switching element comprises a first carrier foil having a first electrode arrangement applied thereon and a second carrier foil having a second electrode arrangement applied thereon, said first and second carrier foils being arranged at a certain distance by means of a spacer in such a way that said first and second electrodes face each other in an active area of said switching element. At least said second electrode arrangement comprises a resistive layer which faces said first electrode arrangement. In response to a pressure acting on said switching element said first and second electrode arrangements are pressed together, the shape and/or the size of a mechanical contact surface between said first and second electrode arrangements being given by a mechanical response function depending on the amount of pressure applied. According to the invention, said resistive layer has a shape such that an electrical response function of said sensor is decoupled from said mechanical response function.

13 Claims, 7 Drawing Sheets

Figure 7:
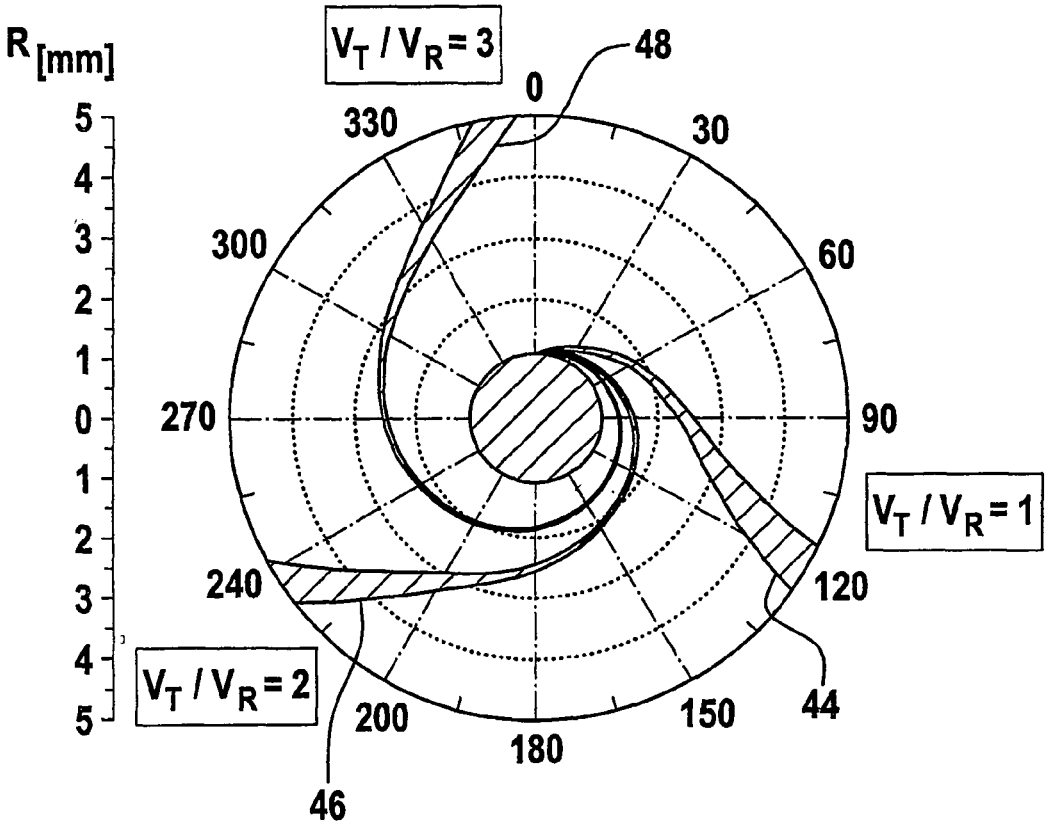

Fig. 1
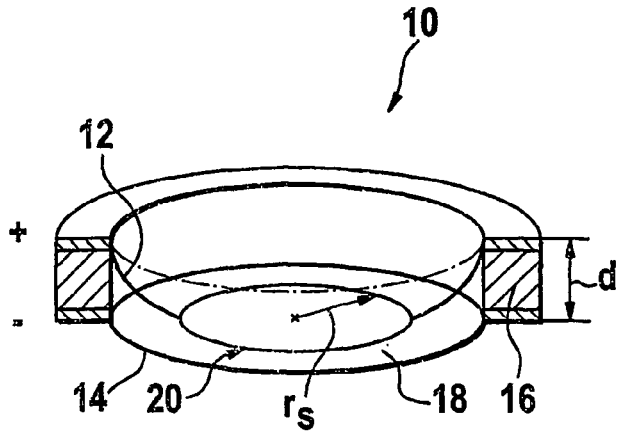
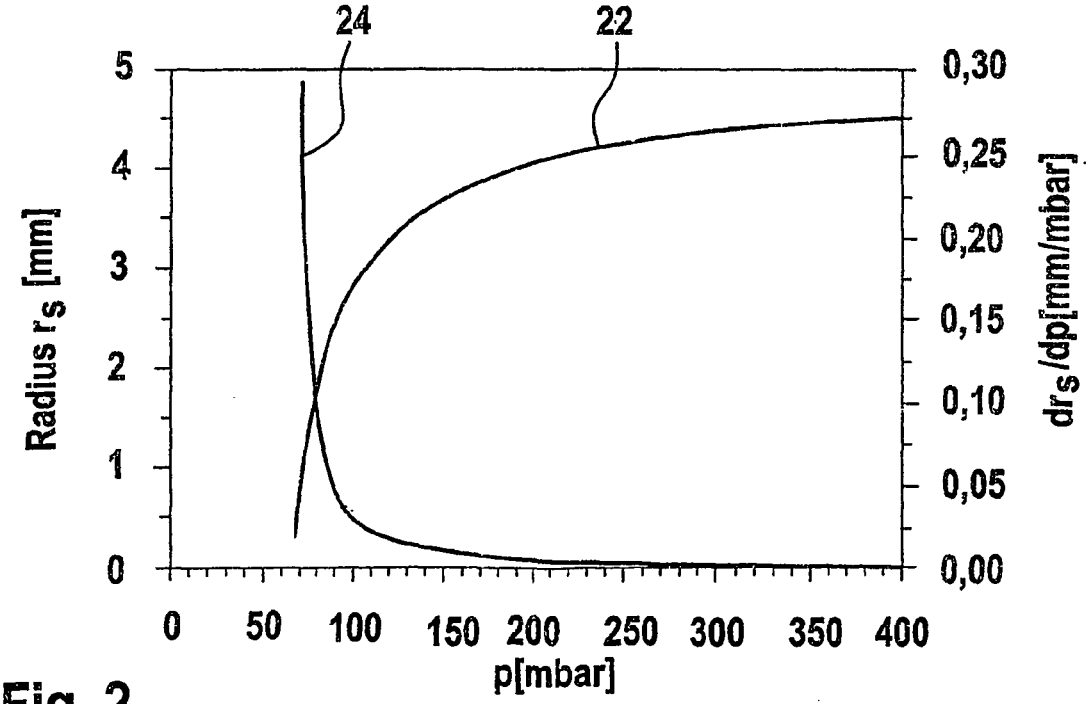
Fig. 2

Fig. 3
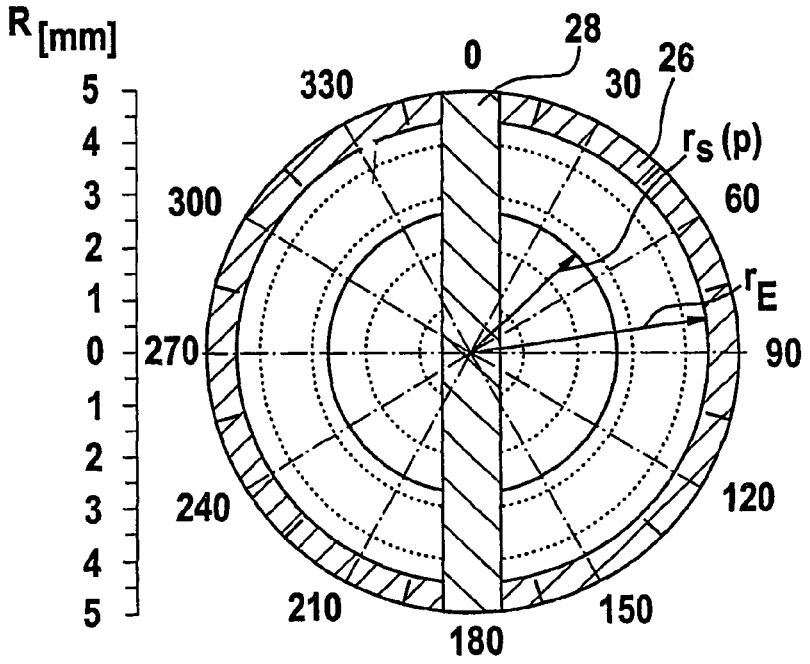
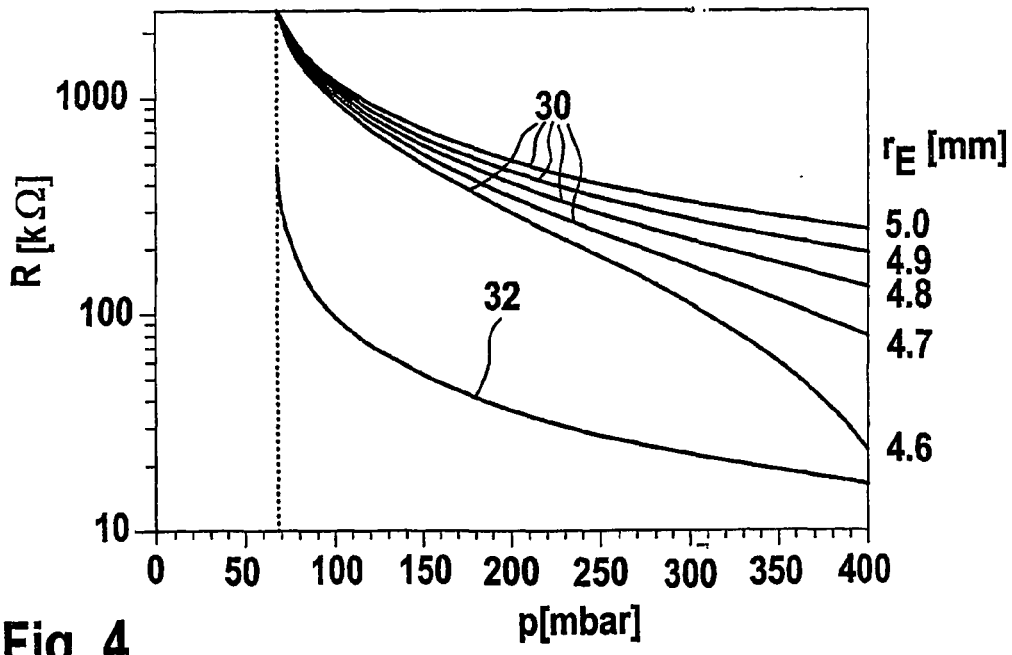
Fig. 4

Fig. 5
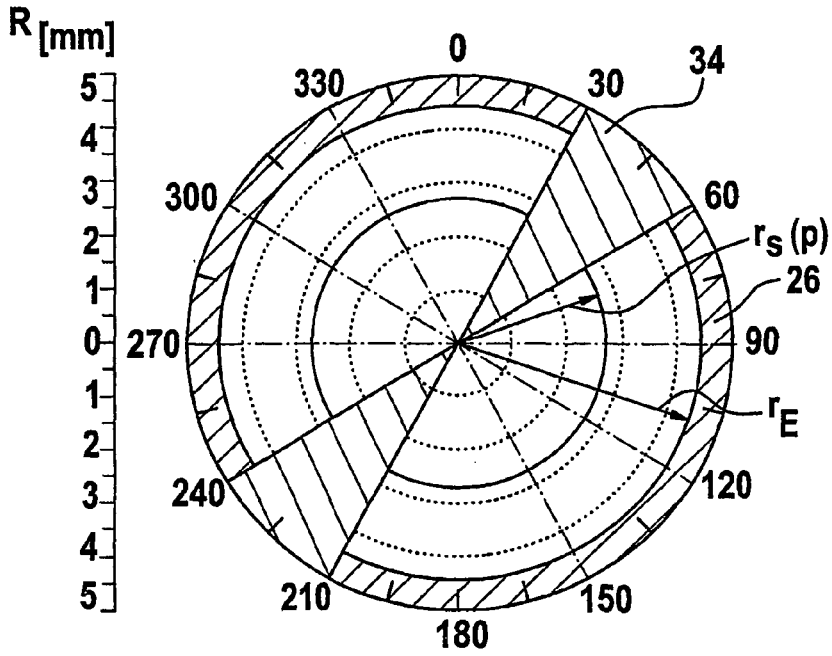
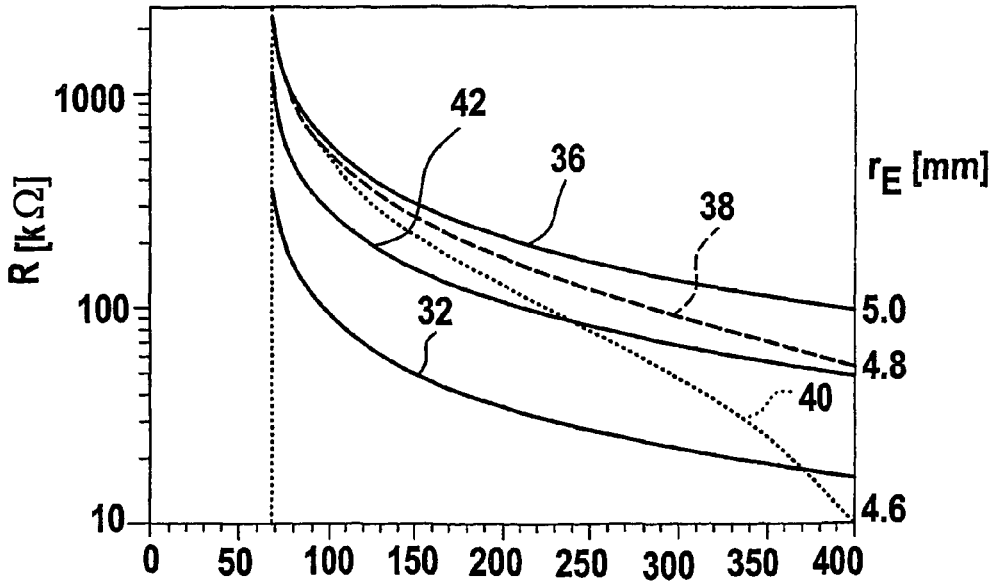
Fig. 6

Fig. 10
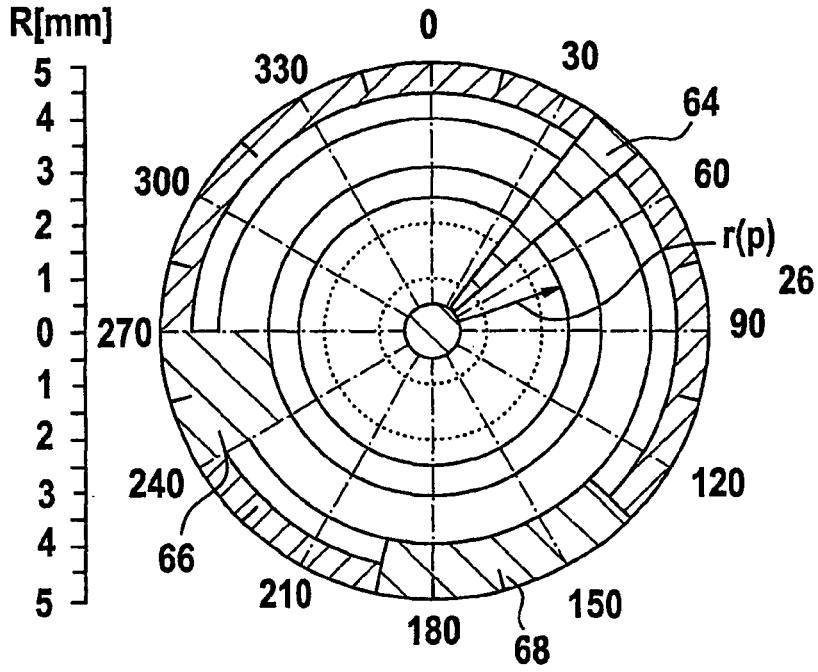
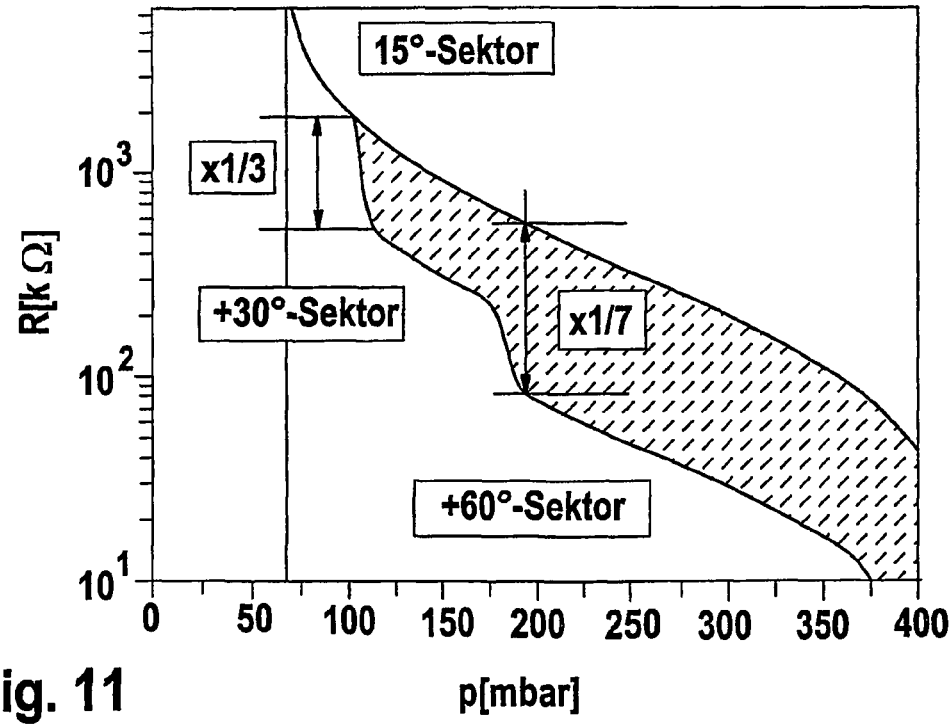
Fig. 11

Fig. 12a
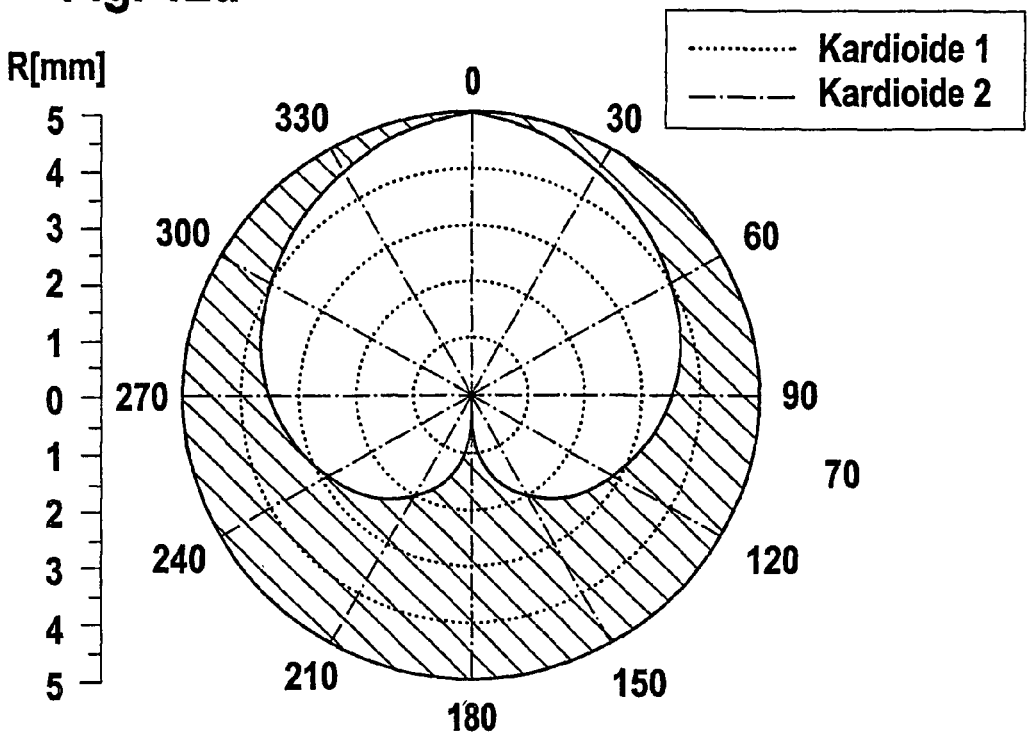
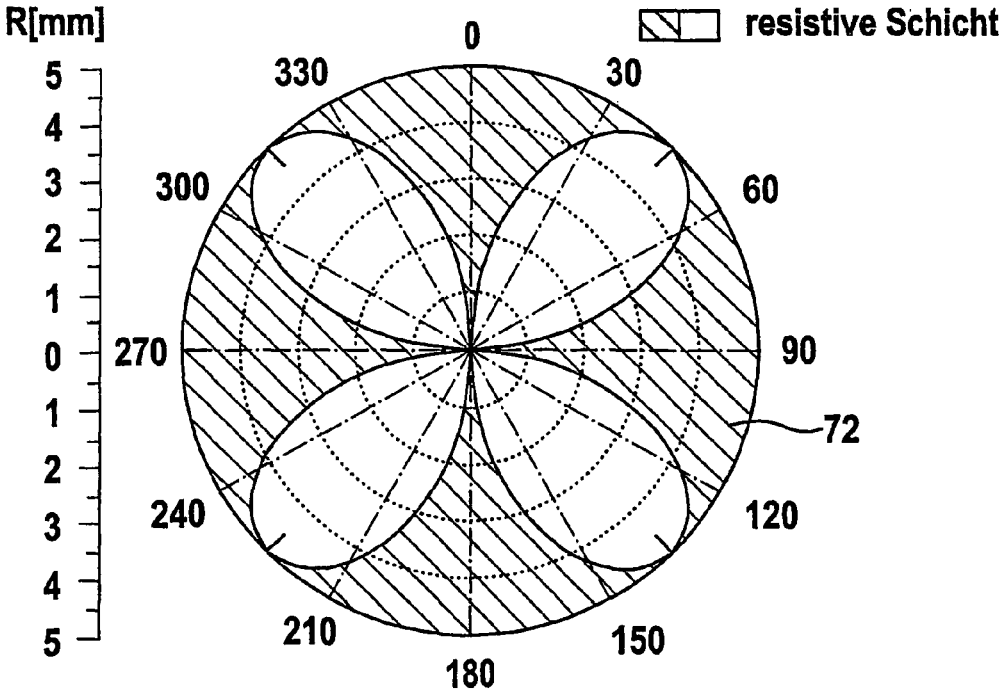
Fig. 12b

FOIL-TYPE SWITCHING ELEMENT

INTRODUCTION

The present invention relates to a foil-type switching element comprising a first carrier foil having a first electrode arrangement applied thereon and a second carrier foil having a second electrode arrangement applied thereon, said first and second carrier foils being arranged at a certain distance by means of a spacer in such a way that said first and second electrodes face each other in an active area of said switching element. In response to a pressure acting on said switching element, said first and second electrode arrangements are pressed together against the reaction force of the carrier foils so that the electrical resistance between said first and second electrode arrangement decreases.

In known switching elements of this type, at least one of the electrode arrangements comprises a planar electrode and a resistive layer having a suitably high electrical resistance, e.g. a suitable semi-conductive material. The resistive layer completely covers the planar electrode. The mechanical response of such a sensor can be described by a membrane model. The deflection of the membrane is proportional to the pressure acting vertically on the membrane and depends on the elastic properties of the membrane, its thickness and the radius of the restraining device. In this case, the resistance between the connections of the two electrode arrangements depends on the radius, i.e. the size of the contact surface between the two electrode arrangements. As the size of the contact area depends on the pressure acting on the switching element, the electrical resistance of the switching element is directly correlated to the pressure acting on the switching element. It follows that such a switching element can be used as a pressure sensor. A foil-type switching element of this kind is disclosed in the international patent application WO-A-99/38179.

Such pressure sensors can be manufactured cost-effectively and have proved to be extremely robust and reliable in practice. The electrical response, i.e. the dynamics, of such pressure sensors is, however, unsuitable for certain applications. Whereas, in the case of sensors which are generally round, the radial expansion of the mechanical contact surface area is essentially a specific function of the force exerted on the switching element, an essentially quadratic dependence of this radius is obtained for the area of the contact surface. The resistance behavior of the sensor as a function of the force consequently exhibits a characteristic determined by this quadratic dependence, which renders the sensors unsuitable for particular applications. In order to adjust the electrical response function of the sensor to specific applications, WO-A-99/38179 further discloses to design the resistive layer in such a way, that its electrical resistivity varies with the distance from the center of the active area. This variation of the resistivity is achieved by the introduction of a second material into the resistive layer.

While such a specific design of the resisitivity of the resistive layer may prove useful for certain types of switching elements, there are types of sensors where such an embodiment of the resistive layer does not provide the desired response of the sensor.

OBJECT OF THE INVENTION

The object of the present invention is to provide a switching element with improved electrical response.

GENERAL DESCRIPTION OF THE INVENTION

This object is achieved by a switching element according to claim 1. Such a foil-type switching element comprises a first carrier foil having a first electrode arrangement applied thereon and a second carrier foil having a second electrode arrangement applied thereon, said first and second carrier foils being arranged at a certain distance by means of a spacer in such a way that said first and second electrodes face each other in an active area of said switching element. At least said second electrode arrangement comprises a resistive layer which faces said first electrode arrangement. In response to a pressure acting on said switching element said first and second electrode arrangements are pressed together, the shape and/or the size of a mechanical contact surface between said first and second electrode arrangements being given by a mechanical response function depending on the amount of pressure applied. According to the invention, said resistive layer has a shape such that an electrical response function of said sensor is decoupled from said mechanical response function.

The electrical response function R(p) of the switching element is generally determined by the shape and/or the size of an electrical contact surface between said resistive layer and said first electrode arrangement. It follows that by adjusting the shape of the resistive layer, a mismatch between the mechanical and the electrical contact surface is generated, which considerably influences the electrical response of the switching element. With the switching element of the present invention, the electrical response function can be tuned simply by suitably shaping the resistive layer. It has to be noted that neither the resisitivity of the resistive layer nor its thickness has to be modified in order to achieve the desired response.

In a possible embodiment of the invention, said first electrode arrangement also comprises a resistive layer which faces said second electrode arrangement. In this case, the resistive layers of said first and second electrode arrangements have a shape such that an electrical response function of the switching element is decoupled from said mechanical response function. In this embodiment, both resistive layers can be specifically shaped in order to generate a desired response function of the switching element. It has to be noted, that the shapes of the two resistive layers may be either equal or different, depending on the desired response of the sensor.

The present invention relates to switching elements of two different types. In a first embodiment, the first electrode arrangement comprises a planar electrode covering substantially the entire surface of the active area of said switching element, whereas said second electrode arrangement comprises an peripheral electrode arranged substantially at a periphery of said active area, said resistive layer extending inwardly from said peripheral electrode. If a voltage is applied across the electrode arrangements and if the planar electrode is pressed against the resistive layer of the second electrode arrangement, an electrical current flows from the periphery of the electrical contact surface radially through the resistive layer towards the peripheral electrode. In this case, the resistance of the switching element is determined by the resistance of the non-contacted region of the resistive layer, i.e. the part of the resistive layer lying between the periphery of the mechanical contact surface and the peripheral electrode. It is clear that for a given radius of the mechanical contact surface and a given radius of the peripheral electrode, this resistance of the switching element considerably varies with the surface covered by the resistive layer, the resistance being higher for a smaller covering ratio. Thus by adjusting the ratio of covered surface to non-covered surface, a specific resistance for each pressure, i.e. a specific response function R(p) can be achieved.

It has to be noted that in a variant of this first type of switching elements with two resistive layers, each of said first and second electrode arrangements may comprise a peripheral electrode arranged substantially at a periphery of said active area, said resistive layers extending inwardly from said peripheral electrode.

In a second embodiment of the switching element, each of said first and second electrode arrangements comprises a planar electrode covering substantially the entire surface of the active area of said switching element and said resistive layer is arranged on top of said first or second planar electrode. If a voltage is applied across the electrode arrangements and if the planar electrode is pressed against the resistive layer of the second electrode arrangement, an electrical current flows from the boundary layer between the first electrode arrangement and the resistive layer vertically through the resistive layer towards the second planar electrode. In the present case, the resistance of the switching element is determined by the resistive material below the mechanical contact surface and the second planar electrode. Again, the resistance will be higher for a smaller covering ratio.

It should be noted, that for a planar electrode covering the entire active area, those regions of the planar electrode, which are not coated by the resistive material may be coated with an insulating material in order to prevent a direct contact between the first and the second electrode.

Independent of the type of the switching element, the resistive layer may comprise a resistive strip extending across said active area. The resistive strip is e.g. printed onto the carrier foil and the peripheral electrode deposited on said carrier foil. In this embodiment, the resistance between the periphery of the contact surface and the peripheral electrode varies substantially linearly with the difference between the radii of the peripheral electrode and the contact surface. Hence the corresponding electrical response function R(p) is closer to a linear behavior than the corresponding response function of a resistive layer fully covering the active area, i.e. a disc shaped resistive layer.

In an other embodiment, said resistive layer comprises at least one resistive angular segment extending from a periphery of said active area towards a center of said active area, said angular segment tapering towards said center of said active area. In this case, the ratio between covered and uncovered areas per annular increment is constant. The electrical response function of this embodiment has a shape similar to the one of a resistive disc, however the absolute resistance values are increased with respect to those of the disc shaped resistive layer. It should be noted that the center of the active area does not necessarily designate the geometrical center but rather the contact center, i.e. the point in which a contact between the first and second electrode arrangement first occurs. It will further be appreciated that the radial dimension of the angular segment may be smaller than the radius of the active area, i.e. the annular segment does not extend to the center.

In order to increase the length of the current flow path between the periphery of the contact surface and the peripheral electrode and accordingly the resistance of the switching element, the resistive layer may also comprise a vortex segment extending from a periphery of said active area towards a center of said active area.

It should be noted, that any combinations of the above mentioned embodiments of the resistive layer may be used in order to achieve a predefined response function R(p). For instance a combination of several angular segments having different aperture angles and different radial dimensions leads to a step function shape of the corresponding electrical response function of the switching element.

DETAILED DESCRIPTION WITH RESPECT TO THE FIGURES

Figure 8:
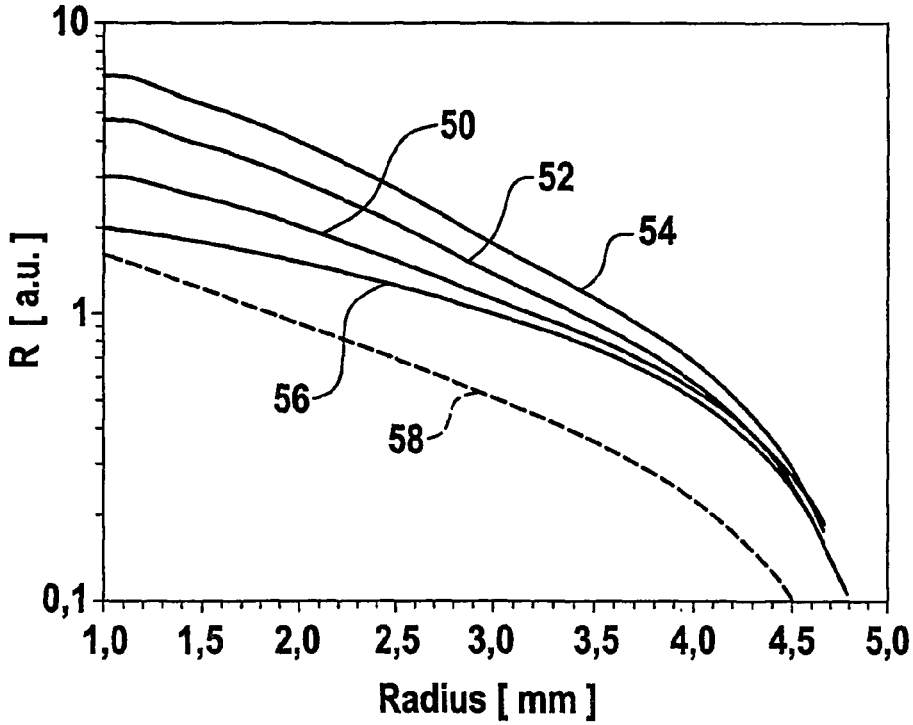
Figure 9:
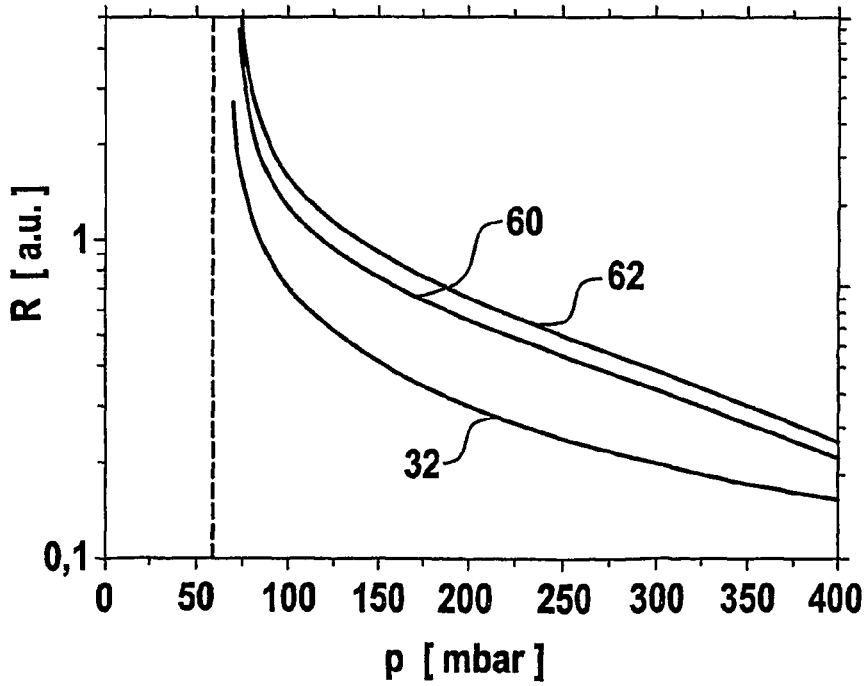

The present invention will be more apparent from the following description of several not limiting embodiments with reference to the attached drawings, wherein FIG. 1: shows a representation of the membrane model of a circular switching element according to the present invention FIG. 2: shows a graphical representation of the radius of the mechanical contact surface versus pressure FIG. 3: shows an embodiment of a second electrode arrangement, wherein the resistive layer comprises a resistive strip;

FIG. 4: shows the electrical response functions of a switching element comprising the electrode arrangement of FIG. 3;

FIG. 5: shows an embodiment of a second electrode arrangement, wherein the resistive layer comprises two angular segments;

FIG. 6: shows the electrical response functions of a switching element comprising the electrode arrangement of FIG. 5;

FIG. 7: shows an embodiment of a second electrode arrangement, wherein the resistive layer comprises several vortex segments;

FIG. 8: shows a graphical representation of the resistance versus radius of the contact surface;

FIG. 9: shows the electrical response functions of a switching element comprising the electrode arrangement of FIG. 7;

FIG. 10: shows an embodiment of a second electrode arrangement, wherein the resistive layer comprises several angular segments with different aperture angles and different radial dimensions;

FIG. 11: shows the electrical response functions of a switching element comprising the electrode arrangement of FIG. 10;

FIG. 12: shows two further possible embodiments of the resistive layer.

FIG. 1 generally represents the membrane model of a circular switching element 10. A first carrier foil 12 and a second carrier foil 14 are arranged at a certain distance d by means of a spacer 16. The spacer 16 surrounds a circular active area 18 of the switching element and defines the radius $r_M$ of the membrane. In response to a pressure acting on the switching element, the carrier foil 12 is bend towards the carrier foil 14 until electrode arrangements arranged on the carrier foils come into contact. Once contact is established, the radius $r_S$ of the mechanical contact surface 20 increases with increasing pressure p. The representation of this mechanical response function $r_S(p)$ for a typical sensor configuration is shown as 22 in FIG. 2. FIG. 2 further shows a representation of the derivative dr/dp, i.e. of the propagation "speed" of the contact surface. This graph is denoted by reference sign 24.

The following considerations specifically relate to a circular switching element, wherein the first electrode arrangement comprises a disc shaped electrode of a conductive material which covers the entire active area 18, whereas the second electrode arrangement comprises an annular contact electrode of a conductive material arranged at the periphery of the active area 18 of the switching element. The resistive layer extends inwardly from the annular contact electrode. It should however be noted that analogous observations are valid for switching elements having a non-circular form or switching elements, wherein the second electrode arrangement comprises a disc shaped electrode, which is covered by the resistive layer.

The main aspect of the present invention lies in the fact, that the graph of the electrical response function, i.e. the resistance versus pressure, R(p) may be adjusted in a predetermined manner by suitably shaping the resistive layer of the electrode arrangement. The other parameters of the resistive layer, as e.g. the resistivity and the layer thickness, are not concerned. It will be appreciated, that the dynamic behavior of R(p) can be further optimized by varying the radius $r_E$ of the annular contact electrode of the resistive layer with respect to the radius of the membrane $r_M$.

FIG. 3 shows a view of an embodiment of an electrode arrangement comprising an annular contact electrode 26 having a radius $r_E$, which is arranged substantially at the periphery of the active area 18 of the switching element. In this embodiment, the resistive layer comprises a resistive strip 28, which extends from contact electrode 26 diagonally through the circular active area 18. In the shown configuration, the radius $r_M$ of the membrane equals 5 mm and the width b of the resistive strip equals 1 mm. FIG. 3 further shows the pressure depending radius $r_S(p)$ of the mechanical contact surface of the two carrier foils.

Given the mechanical response function $r_S(p)$ of the radius of the contact surface versus pressure as shown in FIG. 2, this embodiment leads to electrical response functions as shown under 30 in FIG. 4. The different response functions 30 shown in FIG. 4 relate to configurations with different radius $r_E$ of the annular contact electrode. By way of comparison, the electrical response function R(p) of a disc shaped resistive layer is also represented and denoted by reference sign 32. This example clearly demonstrates the significant change of the response function in the case of a resistive strip with respect to the disc shaped prior art resistive layers. Furthermore, the example shows that the behavior of the switching element can be further optimized by varying the radius $r_E$ of the contact electrode 26. It will be appreciated that by providing further resistive strips, the absolute value of the resistance may be reduced.

A further embodiment of the electrode arrangement is shown in FIG. 5. The resistive layer in this embodiment comprises two angular segments 34 having an aperture angle of 30°. The corresponding electrical response function R(p) is shown as 36 in FIG. 6. The relative behavior of this function corresponds to the one of the response function 32 of a disc shaped resistive layer, however the absolute resistance values are higher due to the smaller covering ratio covered area/non-covered area. Graphs 38 and 40, which represent the response functions for different contact electrode radii $r_E$, show that the dynamics of the response function can be optimized by reducing the radius $r_E$ of the contact electrode 26.

By way of comparison, FIG. 6 also shows the electrical response function 42 of an embodiment, wherein the aperture angle of the angular segments is 600. The shape of this graph is similar to the one of graph 36. Due to the higher covering ratio of this embodiment, the resistance values are however smaller than for the embodiment with aperture angle of 30°.

The geometrical structure of the resistive layer also enables to directly control the decreasing speed of the resistance with increasing pressure. The resulting resistance R(p) of a disc shaped resistive layer is directly related to the pressure dependency $r_S(p)$ of the radius of the mechanical contact surface. The very fast increase of the radius $r_S$ with the pressure and the high dynamic of this behavior in the region of the first contact between the two membranes for a standard sensor configuration can be seen in FIG. 2. With prior art sensors having a disc shaped resistive layer, the effective sensor resistance decreases substantially at the same rate. In order to remedy to this problem, a further embodiment of the invention comprises a web-like resistive coating, which tangentially "evades" the radial progression of the contact surface 20 with an "angular velocity" $\omega = r^* (dr/dp)$. Such vortex segments 44, 46 and 48 are represented in FIG. 7 for different tangential contribution to the movement $V_T/V_R$ ($V_T$: tangential velocity, $V_R$: radial velocity).

FIG. 8 shows a graphical representation of the resistance versus radius of the contact surface for the different vortex configurations in comparison to the behavior of the resistive strip 28 of FIG. 3 and the disc shaped prior art design.

Graph 50 corresponds to vortex segment 44, graph 52 corresponds to vortex segment 46 and graph 54 corresponds to vortex segment 48. The behavior of the resistance for a resistive strip and a disc shaped layer are denoted by 56 and 58 respectively. It will be appreciated, that compared to the other designs, the vortex design shows an improved response characteristic of the resistance versus radius. The benefit of this response characteristic will be apparent from the representation of the resistance versus pressure, i.e. the electrical response functions, as shown in FIG. 9. The electrical response functions 60 and 62 of the vortex designs 46 and 48 are plotted as well as the response function 32 of a disc shaped resistive layer. In contrast to the disc shaped layer, the vortex segments show a quasi-linear behavior in a large pressure range.

A step function shaped electrical response function R(p) may be obtained by a resistive layer comprising a combination of different annular sections. Such a design of the resistive layer is shown in FIG. 10. It comprises a first angular segment 64 having an aperture angle of 15° and extending from the peripheral electrode 26 to the center of the active area and two annular sections 66 and 68 having an aperture angle of 30° and 60° respectively. The angular sections 66 and 68 extend inwardly from the peripheral contact electrode 26, their radial dimensions being smaller than that of angular segment 64. The progression of the mechanical contact surface with increasing pressure leads to a successive paralleling of the different resistive segments. This paralleling of the resistances results in steps of the respective electrical response function of the switching element. FIG. 11 shows the response function of an embodiment of FIG. 10, the response function of a simple angular element 64 with aperture angle 150 being plotted as a reference.

Depending on the application of the switching element, further embodiments of the resistive layer are possible. FIG. 12 shows as an example a resistive layer 70 having a cardioid desin (a) and a resistive layer 72 having a trigonometric distribution. (b)

The invention claimed is:

1. Foil-type switching element comprising:

a first carrier foil with a first active electrode arrangement applied thereon; and a second carrier foil with a second active electrode arrangement applied thereon, said first and second carrier foils arranged at a certain distance by a spacer such that said first and second active electrode arrangements face each other in an active area of said switching element, wherein at least said second active electrode arrangement comprises a resistive layer that faces said first active electrode arrangement, wherein, in response to a pressure acting on said switching element, said first and second carrier foils are pressed together so that a mechanical contact surface is established between said first and second carrier foils, wherein a form and a size of said mechanical contact surface is given by an amount of pressure applied and so that an electrical contact surface is established between said first active electrode arrangement and said resistive layer, and wherein said resistive layer has a shape that generates a mismatch between said mechanical contact surface and said electrical contact surface.

2. Switching element according to claim 1, wherein said first active electrode arrangement also comprises a resistive layer that faces said second active electrode arrangement, and wherein said resistive layers of said first and second active electrode arrangements have shapes that generate a mismatch between said mechanical contact surface and an electrical contact surface.

3. Switching element according to claim 1, wherein said first active electrode arrangement comprises a planar electrode covering substantially an entire surface of the active area of said switching element, and wherein said second active electrode arrangement comprises a peripheral electrode arranged substantially at a periphery of the active area, said resistive layer extending inwardly from said peripheral electrode.

4. Switching element according to claim 2, wherein each of said first and second active electrode arrangements comprises a peripheral electrode arranged substantially at a periphery of the active area, said resistive layers extending inwardly from said peripheral electrode.

5. Switching element according to claim 1, wherein each of said first and second active electrode arrangements comprises a planar electrode covering substantially an entire surface of the active area of said switching element, and wherein said resistive layer is arranged on top of said first or second planar electrode.

6. Switching element according to claim 1, wherein said resistive layer comprises a resistive strip extending across the active area.

7. Switching element according to claim 1, wherein said resistive layer comprises at least one resistive angular segment extending from a periphery of the active area towards a center of the active area, said angular segment tapering towards said center of the active area.

8. Switching element according to claim 1, wherein said resistive layer comprises a vortex segment extending from a periphery of the active area towards a center of the active area.

9. Switching element according to claim 2, wherein each of said first and second active electrode arrangements comprises a planar electrode covering substantially an entire surface of the active area of said switching element, and wherein said resistive layers are arranged respectively on top of said first and second planar electrodes.

10. Switching element according to claim 2, wherein at least one of said resistive layers comprises a resistive strip extending across the active area.

11. Switching element according to claim 2, wherein each resistive layer comprises a resistive strip extending across the active area.

12. Switching element according to claim 2, wherein at least one of said resistive layers comprises at least one resistive angular segment extending from a periphery of the active area towards a center of the active area, said angular segment tapering towards said center of the active area.

13. Switching element according to claim 2, wherein at least one of said resistive layers comprises a vortex segment extending from a periphery of the active area towards a center of the active area.

* * * * *